United States Patent [19]

Kobayakawa et al.

[11] 4,220,894

[45] Sep. 2, 1980

[54] FLUORESCENT DISPLAY PANEL COMPRISING A GRID LEAD HAVING AN INDENT

[75] Inventors: Masaki Kobayakawa; Toshio Okada, both of Kagoshima, Japan

[73] Assignee: Nippon Electric Kagoshima, Limited, Kagoshima, Japan

[21] Appl. No.: 959,001

[22] Filed: Nov. 9, 1978

[30] Foreign Application Priority Data

Nov. 11, 1977 [JP] Japan ..... 52-151953[U]

[51] Int. Cl.[2] ..... H01J 63/02

[52] U.S. Cl. ..... 313/496; 313/269

[58] Field of Search ..... 313/496, 497, 269

[56] References Cited

U.S. PATENT DOCUMENTS 4,023,876 5/1977 Fukunaga et al. ..... 313/497

4,132,920 1/1979 Kobayakawa et al. ..... 313/497

FOREIGN PATENT DOCUMENTS 2828169 4/1979 Fed. Rep. of Germany ..... 313/497

*Primary Examiner*—Robert Segal

*Attorney, Agent, or Firm*—Hopgood, Calimafde, Kalil, Blaustein & Lieberman

[57] ABSTRACT

In a fluorescent display panel comprising a grid member comprising, in turn, a pair of grid leads extended integrally from a grid frame to which a grid is attached, each grid lead is fixed to a substrate of the panel. When driven in a time division fashion, the panel produces audible noises disagreeable to the ear. In order to reduce the noises, at least one of the grid lead pair is deformed perpendicularly of the grid at its portion between the grid frame and the portion at which the grid lead is fixed to the substrate. The deformation may be an indent directed either away or towards the substrate, with the thickness of the grid lead rendered at the position of the indent. The deformation may alternatively be a bend, with the thickness kept uniform. Also in the latter case, an indent is formed in the grid lead.

4 Claims, 4 Drawing Figures

FLUORESCENT DISPLAY PANEL COMPRISING A GRID LEAD HAVING AN INDENT

BACKGROUND OF THE INVENTION

This invention relates to a fluorescent display panel. It should be noted that fluorescence is not much different from phosphorescence and that the word "fluorescent" is used throughout the instant specification to cover the concept of luminescence emitted by a phosphorescent material with a shorter duration.

As will later be described with reference to a few figures of the accompanying drawing, it is usual that each grid member of a fluorescent display panel comprises a pair of grid leads extended along a substrate of the panel and fixed to a pair of peripheral areas of the substrate, respectively. When driven in a time division fashion, such a display panel produces audible noises disagreeable to the ear. A conventional fluorescent display panel of the type has therefore been defective in operation.

SUMMARY OF THE INVENTION

It is therefore a general object of the present invention to provide a fluorescent display panel, which is excellent in operation.

It is a specific object of this invention to provide a fluorescent display panel, which scarcely produces disagreeable noises.

A fluorescent display panel to which this invention is applicable comprises a substrate member which has a principal surface having a center area, a first peripheral area on one side of the center area, and a second peripheral area on the other side of the center area, a plurality of anode units on the center area, a plurality of grid members in one-to-one correspondence to the anode units, and a hot cathode over the grid members. Each of the grid members comprises a conductive frame, a grid on the frame, and a first and a second grid lead. The grid has a grid surface juxtaposed to the anode unit to which that grid is in one-to-one correspondence. The first and the second grid leads are extended from the frame onto the first and the second peripheral areas, respectively, and have a first and a second portion fixed to the first and the second peripheral areas, respectively. According to this invention, at least one of the first and the second grid leads comprises a deformed portion between the frame and a relevant one of the first and the second portions. The deformed portion should be deformed substantially perpendicularly of the grid surface.

BRIEF DESCRIPTION OF THE DRAWING

FIG. 1 schematically shows, with parts cut away, a perspective view of a conventional fluorescent display panel to which a fluorescent display panel according to the instant invention is very similar;

DESCRIPTION OF THE PREFERRED EMBODIMENTS

Figure 1:
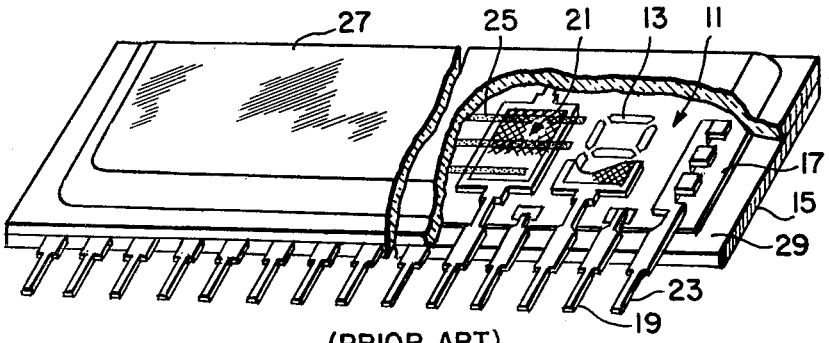
(PRIOR ART) FIG. 1
Figure 2:
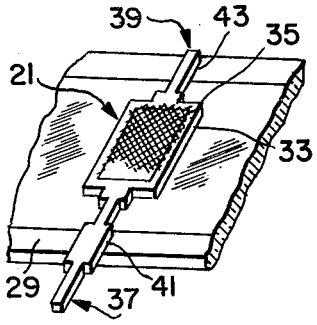
(PRIOR ART) FIG. 2
FIG. 2 is a schematic perspective view of a grid member of the conventional fluorescent display panel depicted in FIG. 1.

Referring to FIGS. 1 and 2, a conventional fluorescent display panel will be described at first for a better understanding of the present invention. As best shown in FIG. 1, the display panel comprises a substrate member 11 having a principal surface and a plurality of anode units 13 on the principal surface. Each of the anode units 13 comprises a plurality of segmented fluorescent anodes arranged in a substantial figure-of-eight configuration. The substrate member 11 comprises a substantially rectangular substrate 15 of an electrically insulating material, such as glass, alumina, or other ceramic. The substrate 15 has a front surface surrounded by four side edges. A multiplicity of anode conductors (not shown) of the respective segmented anodes are formed on the front surface together with a plurality of anode inner leads (not shown) as by silver prints. When each anode unit 13 comprises the segmented anodes in a predetermined configuration, prescribed ones of the anode conductors of the respective anode units 13 are connected to one of the anode inner leads. The substrate member 11 further comprises an insulator layer 17 on the front surface to cover the anode inner leads with through holes formed on the respective anode conductors and anode inner leads. The insulator layer 17 is formed on a central portion of the front surface preferably of glass, such as lead borosilicate glass, as by screen printing and subsequent firing. The insulator layer 17 may be several microns thick. A layer of a fluorescent material is electrodeposited or otherwise sedimented on each of the anode conductors in contact therewith through pertinent ones of the through holes. Each of the segmented anodes may further comprise an intermediate layer of a conductive material, such as graphite, between the anode conductor and the fluorescent layer. It should be noted in this connection that the exposed surface of the substrate 15 serves as a portion of the principal surface of the substrate member 11 and that the anode units 13 may be somewhat recessed from the principal surface even though the anode units 13 are said to be on the principal surface.

Further referring to FIG. 1, a frame assembly is preliminarily manufactured. The assembly comprises a plurality of anode lead-inleads 19, a plurality of grid members 21 in one-to-one correspondence to the anode units 13, and a pair of cathode leads 23 to which three hot cathodes 25 are welded in the example illustrated. The assembly is placed on the insulator layer 17. A mass of glass frit having a melting point lower than the material of the insulator layer 17 is put around the insulator layer 17. A glass cover 27 has peripheral flanges surrounding a viewing window. After the flanges are positioned on the glass frit mass, the mass is fused to provide a fused glass frit layer 29 that is a little thicker than the insulator layer 17 and hermetically seals the substrate member 11 and the glass cover 27 with the anode and the cathode leads 19 and 23 interposed therebetween and the anode leads 19 brought into electrical contact with the inner leads through the remaining ones of the through holes. For the purpose of the electrical connection, free ends of the respective anode leads 19 are slightly bent away from the hot cathodes 25. After evacuation, an exhaust pipe (not shown) is sealed.

Thereafter, the frame assembly is cut to leave the leads 19 and 23 as shown. For convenience of further description, that interface of the fused glass frit layer 29 along which the anode and the cathode leads 19 and 23 are sealed will be called a first and a second peripheral area of the principal surface of the substrate member 11.

Referring more particularly to FIG. 2, each of the grid members 21 comprises a conductive grid frame 33 of a predetermined shape, a grid 35 attached to the frame 33, and first and second grid leads 37 and 39 extended from the frame 33 along a common axis onto the respective peripheral areas of the principal surface of the substrate member 11 and sealed in the fused glass frit mass 29 together with the anode and the cathode leads 19 and 23. The frame 33 and the grid leads 37 and 39 are preferably press-shaped out of an about 0.5 mm thick sheet of a nickel-chromium steel, known as 42–6 alloy. The grid leads 37 and 39 are fixed at first and second portions 41 and 43 to the substrate member 11 by the mass 29. The grid 35 has a grid surface juxtaposed to a corresponding one of the anode units 13.

A fluorescent display panel of the type described with reference to FIGS. 1 and 2 is usually driven in a time division fashion wherein the grid members 21 are cyclically energized by grid driving pulses of a preselected repetition frequency, such as 200 Hz or higher. Under the circumstances, the display panel often produces audible noises disagreeable to the ear. It has now been found that the noises result from the fact that each grid member 21 is set into mechanical vibration by the grid driving pulses with the fixed grid lead portions 41 and 43 serving as nodes. In fact, no noises occur when the grid members 21 are supplied with a d.c. voltage.

Figure 3:
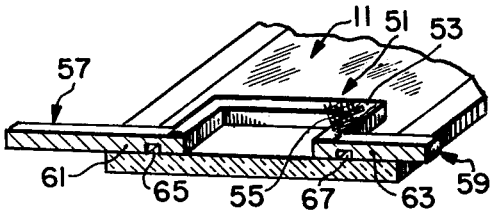
FIG. 3 shows, on a slightly enlarged scale, a schematic fragmentary perspective view of a fluorescent display panel according to a first embodiment of this invention, showing a cross section taken along a common axis of a pair of grid leads of a grid member that is similar to that illustrated in FIGS. 1 and 2.

Referring now to FIG. 3, a fluorescent display panel according to a first embodiment of this invention is similar to that illustrated with reference to FIGS. 1 and 2 except for grid members 51. Like the grid member 21 depicted in FIG. 2, the grid member 51 comprises a conductive grid frame 53, a grid 55, and first and second grid leads 57 and 59. The grid leads 57 and 59 have grid lead portions 61 and 63, respectively, at which the leads 57 and 59 are to be sealed in the fused glass frit layer 29 (FIG. 1). The grid leads 57 and 59 furthermore have deformed portions 65 and 67 between the frame 53 and the respective portions 61 and 63 for fixation to the substrate member 11. Each of the deformed portions 65 and 67 are deformed substantially perpendicularly of the grid surface. Herein, the deformation is provided by rendering the grid leads 57 and 59 thinner at the portions 65 and 67 than the remaining portions of the leads 57 and 59 so that the grid leads 57 and 59 are indented or recessed away from that common surface of the leads 57 and 59 which is to be put on the peripheral areas of the principal surface of the substrate member 11. It has now been confirmed that the disagreeable noises are remarkably reduced even with only one of the grid leads 57 or 59 indented towards the above-mentioned grid lead surface. It is readily possible to form the indent by chemically or otherwise etching the nickel-chromium steel either before or after the press-shaping.

By way of example, a 0.2 mm thick sheet of the nickel-chromium steel was press-shaped into a plurality of grid frames 53 and grid leads 57 and 59. Each frame 53 was 8.0 mm by 4.8 mm in outline. Each grid lead 57 or 59 was 1.4 mm wide. Each indent 65 or 67 had a length of 1.0 mm along the lead 57 or 59 and a depth of 0.1 mm. The grid members 51 were used in a fluorescent display panel wherein the first and the second peripheral areas were spaced apart by 13 mm. No disagreeable noises were audible when the grid driving pulses had a repetition frequency between 270 and 300 Hz.

Figure 4:
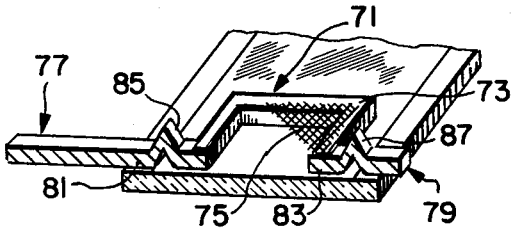
FIG. 4 likewise shows a fluorescent display panel according to a second embodiment of this invention.

FIG. 4 illustrates a fluorescent display panel according to a second embodiment of this invention which is similar to that described hereinabove in conjunction with FIGS. 1 and 2 except for grid members 71. Each of the grid members 71 comprises a grid frame 73, a grid 75, and grid leads 77 and 79. The grid leads 77 and 79 have grid lead portions 81 and 83, respectively, at which the leads 77 and 79 are to be sealed in the fused glass frit layer 29 (FIG. 1). The grid leads 77 and 79 furthermore have deformed portions 85 and 87 between the frame 73 and the respective portions 81 and 83 for fixation to the substrate member 11. Each of the deformed portions 85 or 87 is provided by bending the grid lead 77 or 79 away from a common surface of the leads 77 and 79 which is to be put on the peripheral areas of the principal surface of the substrate member 11. The leads 77 and 79 have a substantially uniform thickness in common.

While this invention has thus far been described in connection with a few preferred embodiments thereof, it is now readily possible for those skilled in the art to carry this invention into effect in various manners. For example, the grid leads 57 and 59 or 77 and 79 may be made integral with the grid frame 53 or 73 along different axes. The grid members 51 or 71 may be formed of a metal sheet of a material other than the nickel-chromium steel provided that the grid leads 57 and 59 or 77 and 79 have a coefficient of thermal expansion substantially equal to that of the fused glass frit mass 29. The deformed portions 65 and 67 or 85 and 87 may be of any other shape that lowers the resonant frequency of each grid member 51 or 71. The etchant for the chemical etch may be a known aqueous solution of iron(II) chloride when the metal sheet for the frame assembly or assemblies is of the 42-6 alloy.

What is claimed is:

1. In a fluorescent display panel comprising a substrate member which has a principal surface having a center area, a first peripheral area on one side of said center area, and a second peripheral area on the other side of said center area, a plurality of anode units on said center area, a plurality of grid members in one-to-one correspondence to said anode units, and a hot cathode over said grid members, each of said grid members comprising a conductive frame, a grid on said frame, and a first and a second grid lead, said grid having a grid surface juxtaposed to the anode unit to which said each grid member is in one-to-one correspondence, said first and said second grid leads being extended from said frame onto said first and said second peripheral areas, respectively, at least one of said first and said second grid leads comprising a deformed portion between the frame and a relevant one of said first and said second portions, said deformed portion being deformed substantially perpendicularly of said grid surface, said deformed protion being thinner than the remaining portion of said at least one grid, wherein said deformed portion comprises an indentation away from said principal surface.

2. A fluorescent display panel as claimed in claim 1, wherein said deformed portion serves to lower the resonant frequency of each of said grid members.

3. In a fluorescent display panel comprising a substrate member which has a principal surface having a center area, a first peripheral area on one side of said center area, and a second peripheral area on the other side of said center area, a plurality of anode units on said center area, a plurality of grid members in one-to-one correspondence to said anode units, and a hot cathode over said grid members, each of said grid members comprising a conductive frame, a grid on said frame, and a first and a second grid lead, said grid having a grid surface juxtaposed to the anode unit to which said each grid member is in one-to-one correspondence, said first and said second grid leads being extended from said frame onto said first and said second peripheral areas, respectively, and having a first and a second portion fixed to said first and said second peripheral areas, respectively, at least one of said first and said second grid leads comprising a deformed portion between the frame and a relevant one of said first and said second portions, said deformed portion being deformed substantially perpendicularly of said grid surface, said deformed portion being thinner than the remaining portion of said at least one grid, wherein said deformed portion comprises an indentation towards said principal surface.

4. The fluorescent display panel as claimed in claim 3, wherein said deformed portion serves to lower the resonant frequency of each of said grid members.

* * * * *